US006884085B1

(12) United States Patent
Goldstone

(10) Patent No.: US 6,884,085 B1
(45) Date of Patent: Apr. 26, 2005

(54) RAISED SERIAL ADVANCED TECHNOLOGY ATTACHMENT (SATA) CONNECTOR FOR HIGH-DENSITY MOUNTING ON A PRINTED CIRCUIT BOARD (PCB)

(75) Inventor: Marc B. Goldstone, Irvine, CA (US)

(73) Assignee: Western Digital Technologies, Inc., Lake Forest, CA (US)

( * ) Notice: Subject to any disclaimer, the term of this patent is extended or adjusted under 35 U.S.C. 154(b) by 0 days.

(21) Appl. No.: 10/609,063

(22) Filed: Jun. 27, 2003

(51) Int. Cl.[7] ..... H01R 12/00
(52) U.S. Cl. ..... 439/62; 439/540.1
(58) Field of Search ..... 439/62, 540.1, 439/65, 638, 378, 374, 677, 567, 660, 79–80, 439/83, 101, 297; 361/753, 792

(56) References Cited

U.S. PATENT DOCUMENTS 6,589,074 B1 * 7/2003 Wu ..... 439/540.1
6,702,620 B2 * 3/2004 Lynch et al. ..... 439/638
6,739,883 B1 * 5/2004 Cheng et al. ..... 439/98
6,764,344 B2 * 7/2004 Maiers ..... 439/629
6,811,427 B2 * 11/2004 Garrett et al. ..... 439/378

* cited by examiner

*Primary Examiner*—Gary Paumen
*Assistant Examiner*—Edwin A. Leon
(74) *Attorney, Agent, or Firm*—Won Tae C. Kim, Esq.; Blakely, Sokoloff, Taylor & Zafman

(57) ABSTRACT

Disclosed is a raised SATA PCB connector for high-density mounting on a PCB. The raised SATA PCB connector is configured for connection with a SATA cable connector and is further configured for mounting onto a first side of a PCB. The raised SATA PCB connector includes a raised mounting portion for mounting to the first side of the PCB. A blade connector may project from the raised mounting portion at a sufficient height from the PCB to allow the blade connector to suitably connect with a SATA cable connector and to allow another SATA cable connector to be suitably connected to another raised SATA PCB connector mounted in opposing relation to the second side of the PCB.

6 Claims, 7 Drawing Sheets

FIG. 6

RAISED SERIAL ADVANCED TECHNOLOGY ATTACHMENT (SATA) CONNECTOR FOR HIGH-DENSITY MOUNTING ON A PRINTED CIRCUIT BOARD (PCB)

BACKGROUND OF THE INVENTION

1. Field of the Invention

The present invention relates to connectors. More particularly, the present invention relates to a raised Serial Advanced Technology Attachment (SATA) connector for high-density mounting on a printed circuit board (PCB).

2. Description of the Prior Art and Related Information

Computers advantageously enable file sharing, the creation of electronic documents, the use of application specific software, and electronic commerce through the Internet and other computer networks. Typically, each computer has one or more storage peripherals. For example, the most common type of storage peripheral is a rotating media storage device (RMSD), such as a disk drive (e.g. a hard disk drive). In particular, host server computer systems that provide services to multiple user computers are increasingly utilizing more and more disk drives to increase the amount of data that can be accessed.

Multiple disk drives are typically connected to a host computer system through a multi-port printed circuit board assembly (PCBA) that includes multiple interface connectors for the transfer of commands, status and data. The host computer accesses the disk drives and reads data from the disk drives and/or saves data to the disk drives. The host computer is typically connected to disk drives via PCB connectors, cable connectors, cables, disk drive connectors, etc. For compatibility, the connectors and interface protocol are standardized. Accordingly, the PCB connector, cable connector, cable, and disk drive connector should comply with the same interface standard. There are several disk drive interface standards, e.g., Advanced Technology Attachment (ATA) and Small Computer System Interface (SCSI) that have become common in the last decade.

However, disk drives are now being designed to comply with a newer standard, generally referred to as the Serial Advanced Technology Attachment (SATA) standard, which is the standard presently favored for newer computers. The SATA standard is being promulgated by the Serial ATA Working Group and is specifically referred to as the Serial ATA: High Speed Serialized AT Attachment specification or Serial ATA standard 1.0. The SATA specification defines various general standards for SATA compatible cable connectors, SATA compatible cables, and SATA compatible PCB and disk drive connectors.

The SATA PCB connector defined in the SATA specification for data transfer basically specifies a male type connector including an insulated housing having a blade connector for supporting an electrical contact arrangement configured for data signals and two board locks fixed to the housing for attaching the PCB connector to a PCB. Further, the SATA PCB connector defined in the SATA specification sets forth that the housing includes two opposite side walls with a guide slot in one of the two opposite side walls, these side walls defining a cable connector receiving area. The guide slot aids in guiding a cable connector to mate with the blade connector of the PCB connector. The SATA specification similarly describes a SATA cable connector that is a female type connector having a receiving area with a suitable electrical contact arrangement configured to mate with the male blade connector of the SATA PCB connector.

Unfortunately, host side SATA specified male blade PCB connectors, when mounted to a Peripheral Component Interface (PCI) board (typically having a standard 0.062 inch thickness), do not allow for SATA cable connectors to be connected to SATA PCB connectors mounted in opposing relation on the top and bottom of the PCI board, respectively. The width of the SATA cable connector's molded housing is to large to allow two SATA cable connectors to be mated with two standard SATA PCB connector's mounted in opposing relation to one another (i.e. one on the top and one the bottom).

A previous attempt, illustrated in FIG. 1, has been made to solve this problem; however, as will be discussed, this prior attempt suffers from some deficiencies. As shown in FIG. 1, a prior configuration 1, utilizes a pair of standard SATA PCB connectors 3 mounted in opposing relation to one another on the top and bottom of a PCB 2, respectively, with an interstitial board 5 mounted between each of the standard SATA PCB connectors 3 and the PCB 2 (e.g. a PCI board), respectively. The interstitial board 5 provides enough height for each of the SATA PCB connectors 3 so that enough clearance is provided to allow a pair of SATA cable connectors 7 to be mounted to two opposed SATA PCB connectors, which utilize the interstitial boards 5.

Unfortunately, the use of the interstitial board 5, as part of this prior configuration 1, creates a few drawbacks. Particularly, the interstitial board 5 is subject to thermal expansion, which may result in the breaking of solder joints. Further, the leads from the electrical contacts of the electrical contact arrangement of the blade connector are routed along the interstitial board 5 subjecting the leads to the thermal expansion of the interstitial board 5 and possible discontinuities and breakage. Moreover, there is nothing to control the impedances in the interstitial board as data signals travel from the SATA PCB connector to the PCI board.

SUMMARY OF THE INVENTION

The present invention relates to a raised Serial Advanced Technology Attachment (SATA) connector for high-density mounting on a printed circuit board (PCB).

In one aspect, the invention may be regarded as a raised Serial Advanced Technology Attachment (SATA) Printed Circuit Board (PCB) connector for mounting to a printed circuit board. The raised SATA PCB connector is configured for connection with a SATA cable connector and is further configured for mounting onto a first side of a PCB in opposing relation with another raised SATA PCB connector, which is similarly mounted onto a second side of the PCB and is also configured for connection with a SATA cable connector. The raised SATA PCB connector includes a blade connector for supporting an electrical contact arrangement compatible with a SATA standard and a raised mounting portion for mounting to the first side of the PCB. The raised mounting portion extends from the first side of the PCB.

The blade connector may be integrally formed with the raised mounting portion and may project from the raised mounting portion. Further, the blade connector may project from the raised mounting portion at a sufficient height from the PCB to allow the blade connector to suitably connect with a SATA cable connector and to allow another SATA cable connector to be suitably connected to another connector mounted in opposing relation to the second side of the PCB.

In one embodiment, the electrical contact arrangement of the blade connector may be configured for data signals in accordance with a SATA standard. Also, the SATA cable connector may include a receiving area formed around the blade connector for receipt of the SATA cable connector.

In further embodiments, the raised SATA PCB connector may include a plurality of extended leads. Each extended lead may be coupled between an electrical contact of the electrical contact arrangement of the blade connector and an electrical contact of the PCB, respectively. Each extended lead is supported by and extends along the raised mounting portion. The extended leads may be coupled to the electrical contacts of the PCB, respectively, by surface mounting. Additionally, in some embodiments, a conductive surface spaced from the electrical contacts of the blade connector and the extended leads may be included in the raised SATA PCB connector. The extended leads extend parallel to, and are spaced with respect to, the conductive surface. Furthermore, in one embodiment, a dielectric may be disposed between the conductive surface and the electrical contacts and the extended leads. For example, the dielectric may be a plastic material or a plastic material loaded with glass.

Additionally, in a more detailed embodiment, the electrical contacts of the blade connector may include ground electrical contacts and the ground electrical contacts may be connected and grounded to the conductive surface. Further, in one embodiment, conductive fasteners may be used to couple the raised mounting portion to the PCB and to a ground plane of the PCB. The conductive surface may then, in turn, be connected to at least one of the conductive fasteners. Moreover, in one embodiment, conductive fasteners may couple the raised mounting portion to the PCB and to the ground plane of the PCB and the ground electrical contacts may be connected and grounded to the conductive surface and the conductive surface may further be connected to at least one of the conductive fasteners.

In some embodiments, the raised SATA PCB connector may include a fastener to mount the raised mounting portion to a through hole of the PCB such that the raised SATA PCB connector is mounted to a first side of the PCB. For example, the fastener may be a mounting barb. In one embodiment, the mounting barb is of a split design such that the mounting barb is usable with a complementary mounting barb also a split design. The complementary mounting barb may have a rotated orientation of approximately 90 degrees with respect to the mounting barb. The complementary mounting barb may be used to mount an opposing raised SATA PCB connector to the through hole on an opposite second side of the PCB.

In another aspect, the invention may be regarded as a multi-port Printed Circuit Board Assembly (PCBA) that includes a Printed Circuit Board (PCB) for mounting within a host computer and a pair of first and second raised Serial Advanced Technology Attachment (SATA) PCB connectors for mounting to the PCB. The first raised SATA PCB connector is configured for connection with a first SATA cable connector and is mounted onto a first side of the PCB. The second raised SATA PCB connector is mounted onto a second side of the PCB in opposing relation to the first raised SATA PCB connector and is also configured for connection with a second SATA cable connector. Each of the first and second raised SATA PCB connectors include a blade connector for supporting an electrical contact arrangement compatible with a SATA standard and a raised mounting portion. The raised mounting portion extends from the PCB.

Each blade connector of each of the first and second raised SATA PCB connectors is integrally formed with the raised mounting portion of each of the first and second raised SATA PCB connectors, respectively, and projects from the raised mounting portion. Further, each blade connector projects from each raised mounting portion of each of the first and second raised SATA PCB connectors, respectively, at a sufficient height from the PCB to allow each blade connector to connect with a respective SATA cable connector such that the first SATA cable connector is connectable to the first raised SATA PCB connector and the second SATA cable connector is connectable to the second raised SATA PCB connector.

In one embodiment, each electrical contact arrangement of each blade connector is configured for data signals in accordance with a SATA standard. Further, each of the first and second raised SATA PCB connectors may include a SATA cable connector receiving area formed around the blade connector for receipt of a SATA cable connector.

In further embodiments, each of the first and second raised SATA PCB connectors may include a plurality of extended leads. Each extended lead may be coupled between an electrical contact of the electrical contact arrangement of the blade connector and an electrical contact of the PCB, respectively. Each extended lead is supported by and extends along the raised mounting portion. The extended leads may be coupled to the electrical contacts of the PCB, respectively, by surface mounting. Additionally, in some embodiments, each of the first and second raised SATA PCB connectors may include a conductive surface spaced from the electrical contacts of the blade connector and the extended leads. The extended leads extend parallel to, and are spaced with respect to, the conductive surface. Furthermore, in one embodiment, a dielectric may be disposed between the conductive surface and the electrical contacts and the extended leads. For example, the dielectric may be a plastic material or a plastic material loaded with glass.

Additionally, in a more detailed embodiment, the electrical contacts of the blade connector may include ground electrical contacts and the ground electrical contacts may be connected and grounded to the conductive surface. Further, in one embodiment, conductive fasteners may be used to couple each respective raised mounting portion to the PCB and to a ground plane of the PCB. The conductive surface may then, in turn, be connected to at least one of the conductive fasteners. Moreover, in one embodiment, conductive fasteners may couple each respective raised mounting portion to the PCB and to the ground plane of the PCB and the ground electrical contacts may be connected and grounded to the conductive surface and the conductive surface may further be connected to at least one of the conductive fasteners.

In some embodiments, each of the first and second raised SATA PCB connectors may include a fastener to mount the raised mounting portion of each of the first and second raised SATA PCB connectors to a through hole of the PCB, respectively, such that the first raised SATA PCB connector is mounted to the first side of the PCB and the second raised SATA PCB connector is mounted to the second side of the PCB. For example, the fastener may be a mounting barb. In one embodiment, a complementary mounting barb may also be used. The mounting barb is of a split design such that the mounting barb is usable with the complementary mounting barb, which is also of a split design. The complementary mounting barb may have a rotated orientation of approximately 90 degrees with respect to the mounting barb. The mounting barb may be used to mount the first raised SATA PCB connector to the first side of the PCB and the complementary mounting barb may be used to mount the second raised SATA PCB connector to the second side of the PCB.

The foregoing and other features of the invention are described in detail below and set forth in the appended claims.

DETAILED DESCRIPTION

Figure 1:
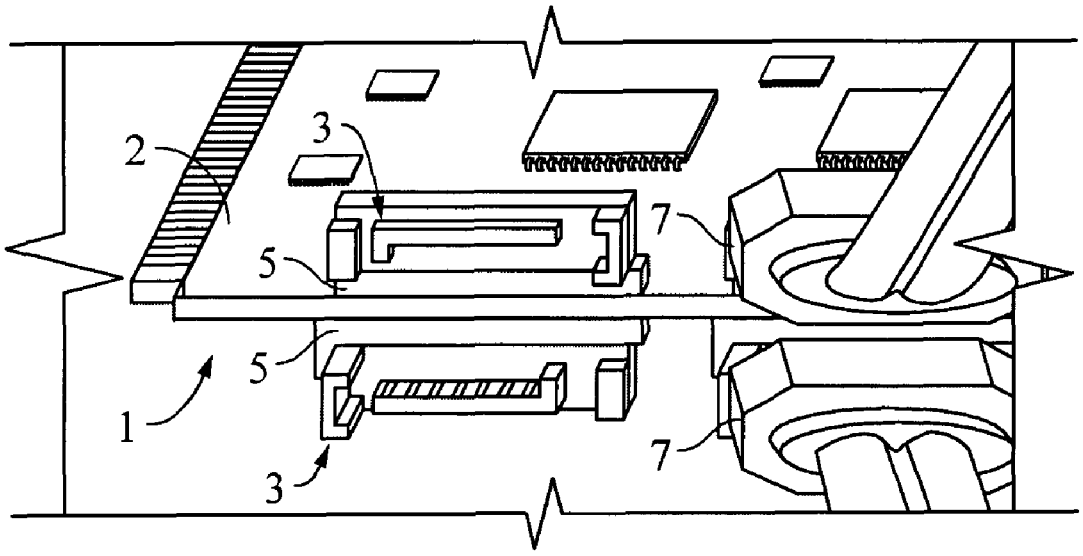
FIG. 1 (Prior Art)
FIG. 1 is a perspective view of a prior art configuration having a pair of standard SATA PCB connectors mounted in opposing relation to one another on the top and bottom of a PCB, respectively, with an interstitial board mounted between each of the standard SATA PCB connectors and the PCB, respectively.
Figure 2:
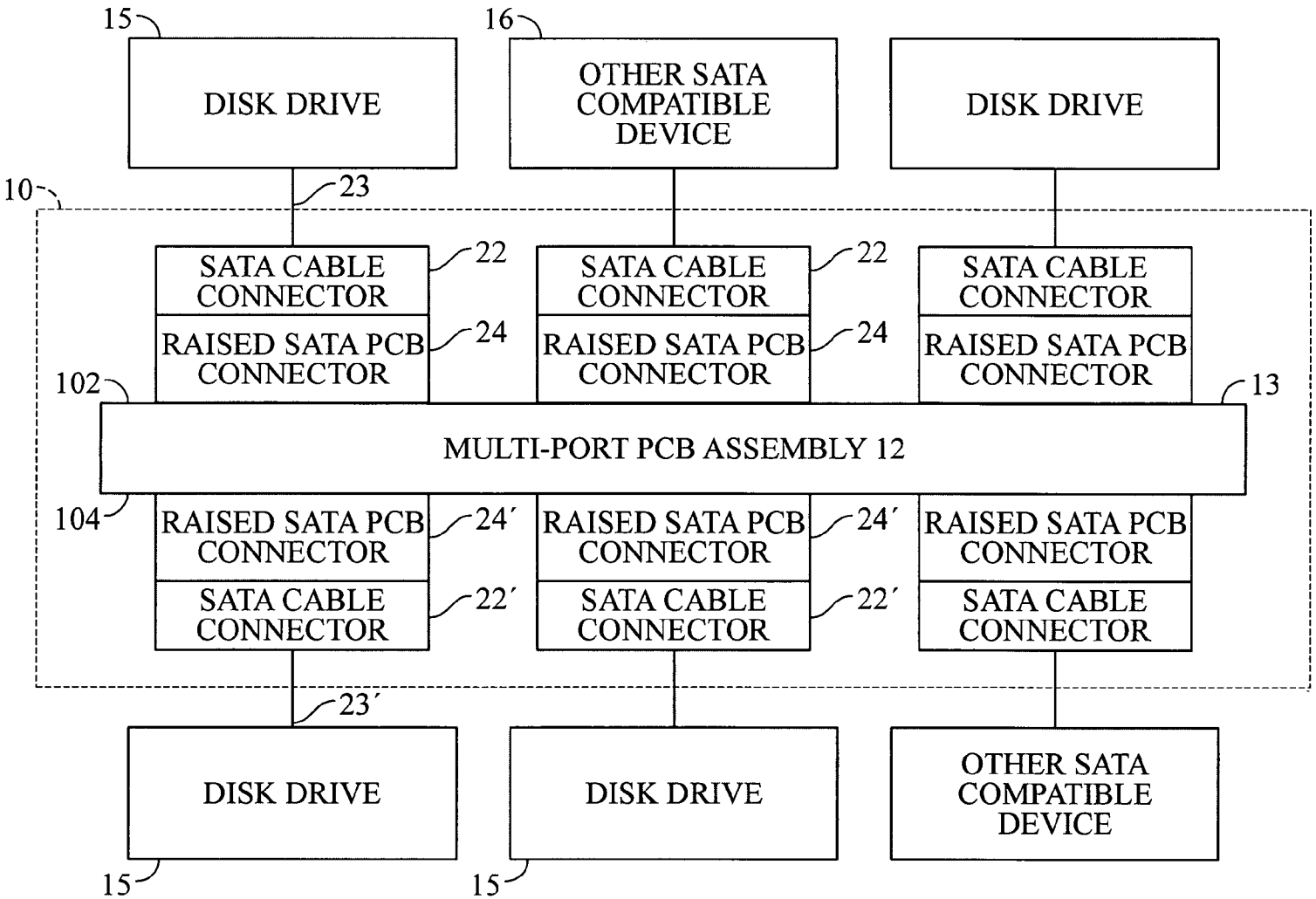
FIG. 2 is a block diagram showing an exemplary host computer system environment, in which embodiments of the invention may be practiced.

With reference now to FIG. 2, FIG. 2 is a block diagram showing an exemplary host computer system environment 10, in which embodiments of the invention may be practiced. For example, the host computer system 10 may be a host server computer system that provides services to multiple user computers. In particular, the host computer system 10 includes a multi-port printed circuit board assembly (PCBA) 12 including a printed circuit board (PCB) 13 that provides an interface to a number of different storage devices. In one embodiment, the PCB 13 may be a peripheral component interface (PCI) card. The storage devices may be any type of suitable storage device such as disk drives 15 (e.g. hard disk drives) or other types of storage devices 16. In one embodiment, the disk drives 15 and the other types of storage devices 16, as well as interface connectors to be discussed, may be compatible with the serial advanced technology attachment (SATA) standard.

Interface connectors connect the PCB 13 of the multi-port PCBA 12 to the disk drives 15 and other storage devices 16 such that the host computer system 10 can communicate with the storage devices. Particularly, the multiple interface connectors allow for the transfer of commands, status, and data. Thus, the host computer system 10 can access the disk drives 15 and can read data from the disk drives and/or save data to the disk drives. The host computer system 10 is typically connected to the disk drives 15 via PCB connectors, cable connectors, cables, disk drive connectors, etc. In this example, for compatibility, the connectors and interface protocol are standardized. Particularly, the PCB connectors, cable connectors, cables and disk drive connectors are in this example all compatible with the SATA standard.

In one aspect, embodiments of the present invention may be regarded as a multi-port PCBA 12 that includes a PCB 13 (e.g. a PCI card) mounted within a host computer system 10 and a plurality of raised SATA PCB connectors 24 mounted onto the PCB 13, in opposing relation to one another, in high-density fashion, to allow for numerous connections to disk drives 15 and other SATA compatible storage devices 16. More particularly, as shown in FIG. 2, embodiments of the invention provide for a first raised SATA PCB connector 24 configured for connection with a first SATA cable connector 22 mounted onto a first side 102 of the PCB 13 and a second raised SATA PCB connector 24' configured for connection with a second SATA cable connector 22' mounted onto a second side 104 of the PCB 13.

In particular, as shown in FIG. 2, the first raised SATA PCB connector 24 and the second raised SATA PCB connector 24' are mounted in opposing relation to each other on the top and bottom sides 102, 104 of the PCB 13, respectively. Furthermore, it should be appreciated that each SATA cable connector 22, 22' is connected to a suitable SATA cable 23, 23', which is further connected to a suitable disk drive connector to interface with a disk drive 15, or other suitable SATA compatible storage device 16, for the transfer of commands, status, and data between the host computer system 10 and the disk drive 15 or other suitable SATA compatible storage device 16.

Figure 3A:
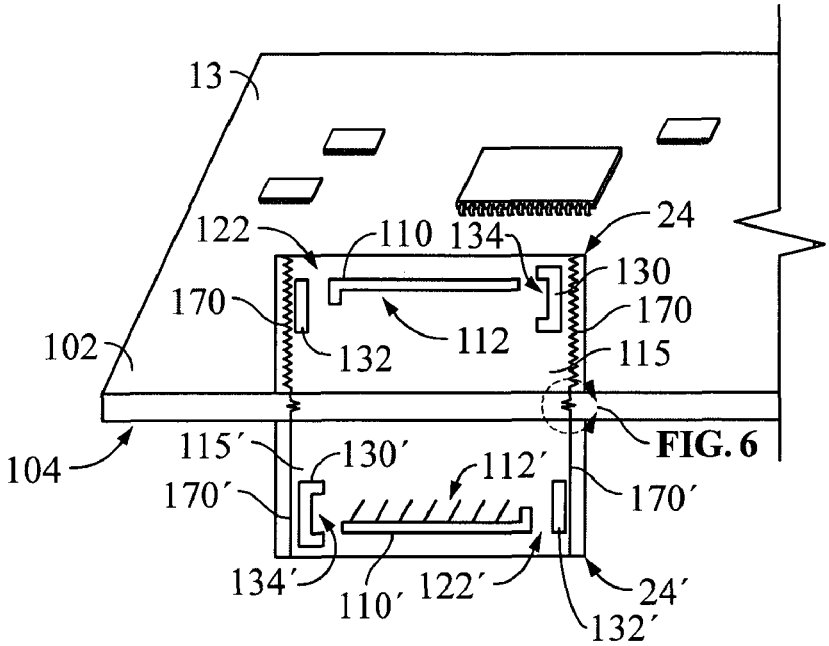
FIG. 3A shows a front view of a first raised SATA PCB connector mounted to a first side of a PCB in opposed relation to a second raised SATA PCB connector mounted to a second side of the PCB, according to one embodiment of the present invention.

Turning now to FIG. 3A, FIG. 3A shows a front view of a first raised SATA PCB connector 24 mounted to a first side 102 of the PCB 13 (i.e. on the top side of the PCB) in opposed relation to a second raised SATA PCB connector 24' mounted to a second side 104 of the PCB (i.e. on the bottom side of the PCB), according to one embodiment of the present invention. Each of the first and second raised PCB connectors 24, 24' include a blade connector 110, 110' for supporting an electrical contact arrangement 112, 112' compatible with a SATA standard. In one embodiment, the electrical contact arrangement 112, 112' includes seven contacts configured for data signals in accordance with the SATA standard.

Each of the first and second raised SATA PCB connectors 24, 24' include a raised mounting portion 115, 115' that is mounted to the PCB 13 and that extends from the PCB 13. As can be seen in FIG. 3A, fasteners 170 and 170' may extend through the raised mounting portions 115, 115' of the first and second raised SATA PCB connectors 24, 24', respectively, and into through holes of the PCB 13 to mount the first and second raised SATA PCB connectors 24, 24', to the PCB 13. However, it should be appreciated that the fasteners need not extend all the way through the raised mounting portions 115, 115' of the first and second raised SATA PCB connectors 24, 24', but may be located at a wide variety of depths within the raised mounting portions 115, 115' to suitably affix the first and second raised SATA PCB connectors 24, 24', to the PCB 13. Further, a wide variety of fasteners may be utilized including mounting barbs, clips, pins, compression fittings, screws, etc. In fact, a particular example of a type of fastener and mounting arrangement will be discussed with reference to FIG. 6, later.

Each L-shaped blade connector 110, 110', including the SATA defined electrical contact arrangements 112, 112' each having seven contacts configured for data signals in accordance with the SATA standard, may be integrally formed with the raised mounting portion 115, 115' of each of the first and second raised SATA PCB connectors 24, 24', respectively, and may project approximately perpendicularly from the raised mounting portion 115, 115', respectively. Further, each of the first and second raised SATA PCB connectors 24, 24' may include a SATA defined cable connector receiving area 122, 122', the components of which may also be integrally molded with the raised mounting portion 115, 115', respectively.

The components of the SATA defined cable connector receiving area 122, 122' include two opposite sidewalls 130, 130', 132, 132' with one of the opposite sidewalls 130, 130' including a guide slot 134, 134'. These two opposite sidewalls in conjunction with the L-shaped blade connector 110, 110 help to define the SATA specified cable connector receiving areas 122, 122'. The guide slots 134, 134' aid in guiding cable connectors to mate with the L-shaped blade connectors 110, 110' of the first and second raised SATA PCB connectors 24, 24'. Moreover, the SATA specification similarly defines a SATA cable connector that is a female type connector having a receiving area with a suitable electrical contact arrangement configured to mate with the male L-shaped blade connector of the SATA PCB connector.

Figure 3B:
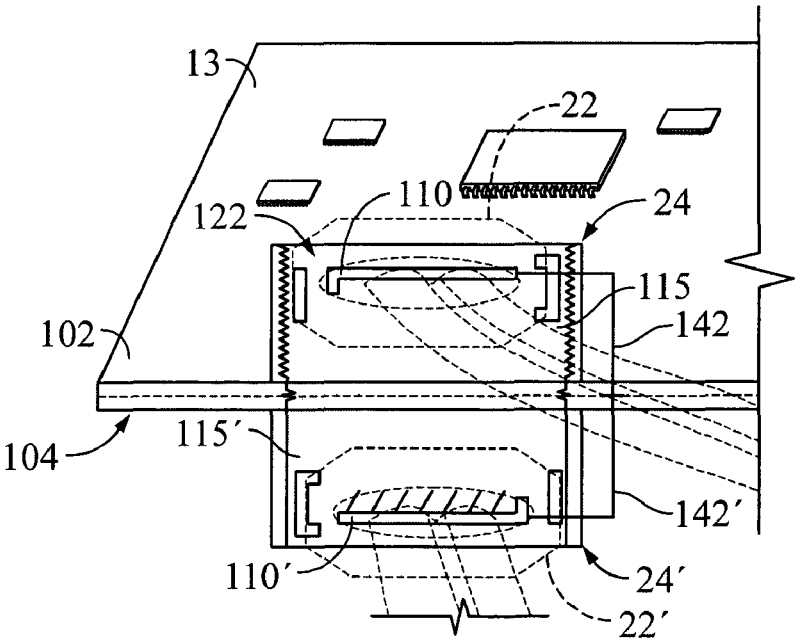
FIG. 3B is similar to that of FIG. 3A and shows first and second raised SATA PCB connectors mounted to the PCB in opposed relation to one another, and further shows in phantom the area that two SATA cable connectors would occupy when suitably mounted to the first and second raised SATA PCB connectors, respectively, according to one embodiment of the present invention.

Referring now to FIG. 3B, FIG. 3B is similar to that of FIG. 3A, showing first and second raised SATA PCB connectors 24, 24' mounted to a PCB 13 in opposed relation to one another, and further shows in phantom the area that two SATA cable connectors 22, 22' would occupy when suitably mounted to the first and second raised SATA PCB connectors 24, 24', respectively, according to one embodiment of the present invention. Particularly, each blade connector 110, 110' projects approximately perpendicularly from each raised mounting portion 115, 115' of each of the first and second raised SATA PCB connectors 24, 24', respectively, at a sufficient SATA cable connector clearance height 142, 142' from the PCB 13 to allow each blade connector 110, 110' to connect with a respective SATA cable connector 22, 22' such that the first SATA cable connector 22 is connectable to the first raised SATA PCB connector 24 and the second SATA cable connector 22' is connectable to the second raised SATA PCB connector 24'.

In this way, raised SATA PCB connectors, according to embodiments of the present invention, may be mounted in opposed relation to one another to the top and bottom surfaces of a PCB, allowing for high-density mounting on the PCB. This advantageously allows for many more disk drives and/or other types of storage devices to be coupled to the PCB of an exemplary host computer system; and further overcomes the problem of the SATA cable connector's housing being too large to allow for top/bottom opposed relation mating of SATA cable connectors to SATA PCB connectors.

Figure 4A:
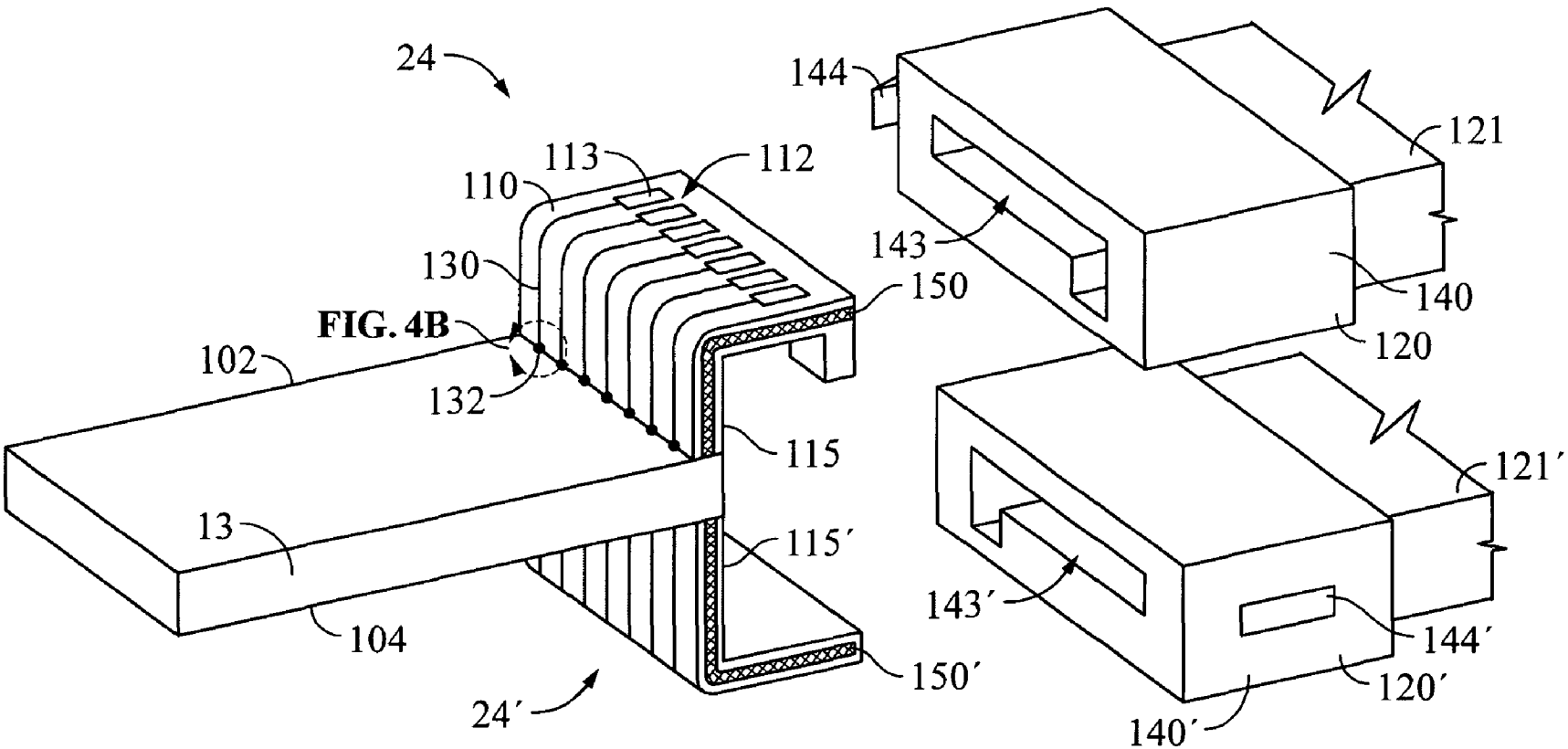
FIG. 4A is a perspective-sectional view of a part of the raised mounting portions and the L-shaped blade connectors projecting therefrom of each of the first and second raised SATA PCB connectors to show certain aspects of the present invention.

Turning now to FIG. 4A, FIG. 4A is a perspective-sectional view of a part of the raised mounting portions 115, 115' and the L-shaped blade connectors 110, 110' projecting therefrom of each of the first and second raised SATA PCB connectors 24, 24' to show certain aspects of the present invention.

Also, FIG. 4A shows a pair a SATA compatible female cable connectors 120, 120' and associated SATA cables 121, 121' for mating to each of the SATA L-shaped blade connectors 110, 110'. Each SATA compatible female cable connector 120, 120' includes a housing 140, 140' having an L-shaped receiving area 143, 143' with a suitable electrical contact arrangement configured to mate with the complementary male L-shaped blade connector 110, 110' of the first and second raised SATA PCB connectors, respectively. Additionally, the housing 140, 140' of each SATA compatible female cable connector 120, 120' includes a guide rail 144, 144' for mating with a guide slot of the SATA defined receiving area of the raised SATA PCB connector to aid in guiding the cable connector to mate with the blade connector of the raised SATA PCB connector, as previously discussed.

As is apparent in FIG. 4A, the components of the second raised SATA PCB connector 24' are the same as that of the components of the first raised SATA PCB connector 24, and therefore, for brevity's sake, only the components of the first raised SATA PCB connector 24 will be discussed, the description thereof applying equally to the components (indicated by the same numbers and a"'"descriptor) of the second raised SATA PCB connector 24'.

As shown in FIG. 4A, the first raised SATA PCB connector 24 includes a plurality of extended leads 130. Each extended lead 130 may be coupled between an electrical contact 113 of the electrical contact arrangement 112 of the blade connector 110 and an electrical contact 132 of the first side 102 of the PCB 13, respectively. Each extended lead 130 is supported by and extends along both the blade connector 110 and the raised mounting portion 115. The leads are termed extended leads because the leads are longer than those commonly used with SATA PCB connectors to accommodate the raised mounting portion's 115 extra height, which, as previously discussed, allows a pair of raised SATA PCB connectors, according to embodiments of the invention, to be mounted in top/bottom opposed relation to one another and to be able to suitably connect to SATA cable connectors. Also, the blade connector 110 and the raised mounting portion 115 may be formed of a suitable material to support the electrical contacts 113 and the extended leads 130. In one embodiment, a suitable material may be an appropriate dielectric such as a plastic material or a plastic material loaded with glass.

Figure 4B:
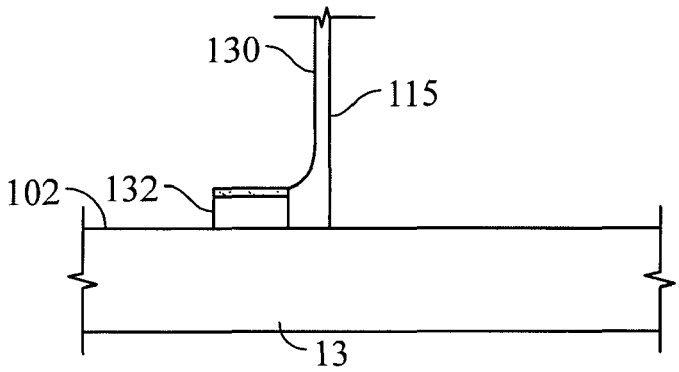
FIG. 4B shows a side-sectional view of a part of the raised mounting portion and the PCB and an extended lead coupled to an electrical contact by surface mounting, according to one embodiment of the present invention.

Each extended lead 130 is suitably coupled to an electrical contact 132 of the first side 102 of the PCB 13. For example, the extended leads 130 may be coupled to the electrical contact 132 of the PCB 13, respectively, by surface mounting. Turning briefly to FIG. 4B, FIG. 4B shows a side-sectional view of a part of the raised mounting portion 115 and PCB 13 and an extended lead 130 coupled to an electrical contact 132 by surface mounting, according to one embodiment of the present invention. Particularly, in this embodiment, the electrical contact 132 is a pad connected to the PCB 13 and the electrical lead 130 is surface mounted to the pad 132. For example, the electrical contact 132 may be a copper pad and the extended lead may soldered to the copper pad.

Turning back to FIG. 4A, in some embodiments, the first raised SATA PCB connector 24 includes a conductive surface 150 disposed within the blade connector 110 and the raised mounting portion 115, which is spaced from the electrical contacts 113 of the blade connector 110 and the extended leads 130. The electrical contacts 113 and the extended leads 130 extended parallel to, and are spaced with respect to, the conductive surface 150. The conductive surface 150 may serve as a ground plane to provide for improved impedance control for the extended SATA data signal leads 130. Further, as previously discussed, a dielectric may be disposed between the conductive surface 150 and the electrical contacts 113 of the blade connector 110 and the extended leads 130. For example, the dielectric may be disposed within the blade connector 110 and the raised mounting portion 115 and may be a plastic material or a plastic material loaded with glass.

Figure 5A:
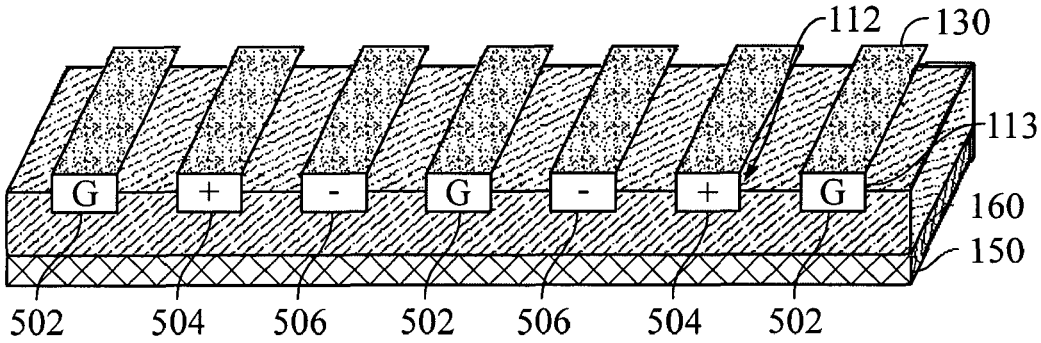
FIG. 5A is a diagram illustrating an example of the electrical contacts of the blade connector and the extended leads extending therefrom along the raised mounting portion with respect to a conductive surface and a dielectric, according to one embodiment of the present invention.

Various configurations for impedance control and grounding of the electrical contacts 113 and the extended leads 130 will now be discussed. First, with reference to FIG. 5A, FIG. 5A is a diagram illustrating an example of the electrical contacts 113 of the blade connector 110 and the extended leads 130 extending therefrom along the raised mounting portion 115 with respect to a conductive surface 150 and a dielectric 160. The electrical contacts 113 may be disposed within the dielectric 160 and spaced a controlled distance from the conductive surface 150. Similarly, the extended leads 130 may also be disposed within the dielectric 160 and spaced a controlled distance from the conductive surface 150. Particularly, the electrical contacts 113 of the SATA specified data signal electrical contact configuration 112 include a plurality of ground contacts 502 and positive and negative differential SATA data contacts 504 and 506, respectively.

In this embodiment, the conductive surface 150 may serve as a ground plane to provide for improved impedance control for the extended SATA data signal leads 130 and the positive and negative differential SATA data contacts 504 and 506. This impedance control may improve the performance characteristics of the high frequency SATA data signals being transmitted. Further, as previously discussed, the dielectric 160, may be disposed between the conductive surface 150 and the electrical contacts 113 of the blade connector and between the conductive surface 150 and the extended leads 130 extending along the raised mounting portion 115. For example, the dielectric 160 may be disposed within the blade connector 110 and the raised mounting portion 115 and may be a plastic material or a plastic material loaded with glass.

Figure 5B:
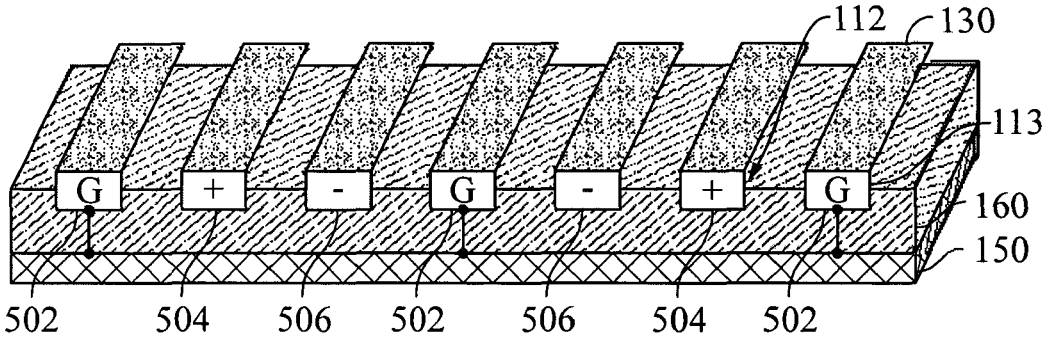
FIG. 5B is a diagram similar to that of FIG. 5A illustrating that ground electrical contacts and associated extended leads may be grounded to the conductive surface for improved grounding and impedance control, according to one embodiment of the present invention.
Figure 5C:
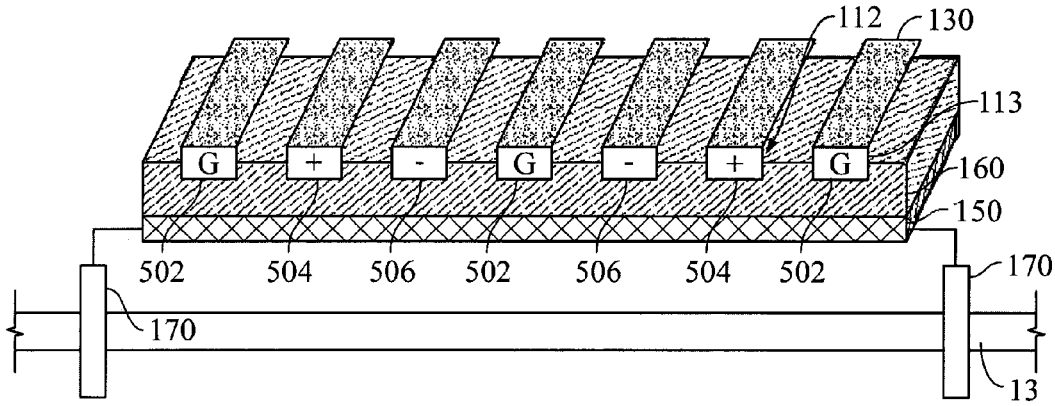
FIG. 5C is a diagram similar to that of FIG. 5A illustrating that that the conductive surface may be grounded to the PCB by conductive fasteners for improved grounding and impedance control, according to one embodiment of the present invention.

With brief reference to FIG. 5B, FIG. 5B is a diagram similar to that of FIG. 5A illustrating that in one embodiment, that ground electrical contacts 502 and associated extended leads 130 may be grounded to the conductive surface 150 for improved grounding and impedance control. Any suitable conductive connection may be utilized for connecting the ground electrical contacts 502 and extended leads 130 to the conductive surface 150. In another variation, with brief reference to FIG. 5C, FIG. 5C is a diagram similar to that of FIG. 5A illustrating that in one embodiment, that the conductive surface 150 may be grounded to the PCB 13 by conductive fasteners 170 for improved grounding and impedance control. The conductive fasteners 170 are used to mount the raised mounting portion 115 of the raised SATA PCB connector to the PCB 13 and also connect to the ground plane of the PCB 13.

Figure 5D:
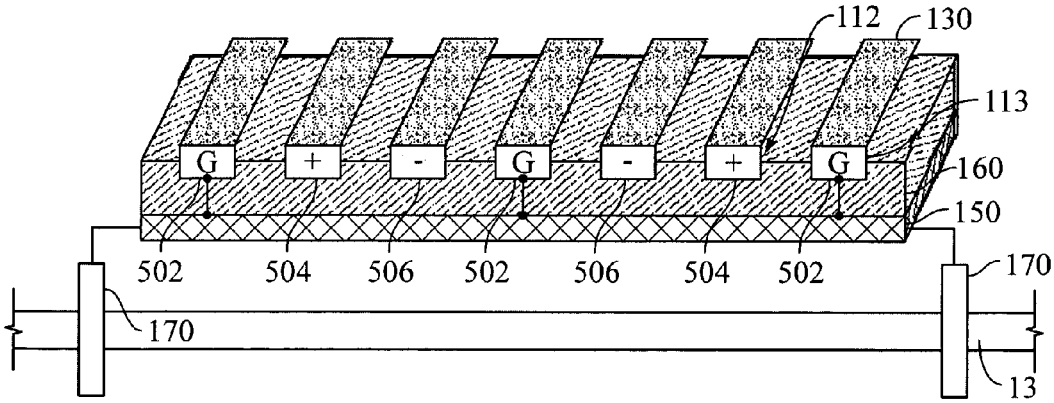
FIG. 5D is a diagram similar to that of FIG. 5A illustrating that ground electrical contacts and associated extended leads may be grounded to the conductive surface and that the conductive surface may be grounded to the PCB by conductive fasteners for improved grounding and impedance control, according to one embodiment of the present invention.

In yet another variation, with brief reference to FIG. 5D, FIG. 5D is a diagram similar to that of FIG. 5A illustrating that, in one embodiment, that the ground electrical contacts 502 and the associated extended leads 130 may be grounded to the conductive surface 150 and that the conductive surface 150 may be grounded to the PCB 13 by conductive fasteners 170 for improved grounding and impedance control. Again, the conductive fasteners 170 are used to mount the raised mounting portion 115 of the raised SATA PCB connector 24 to the PCB 13 and also connect to the ground plane of the PCB 13.

Figure 6:
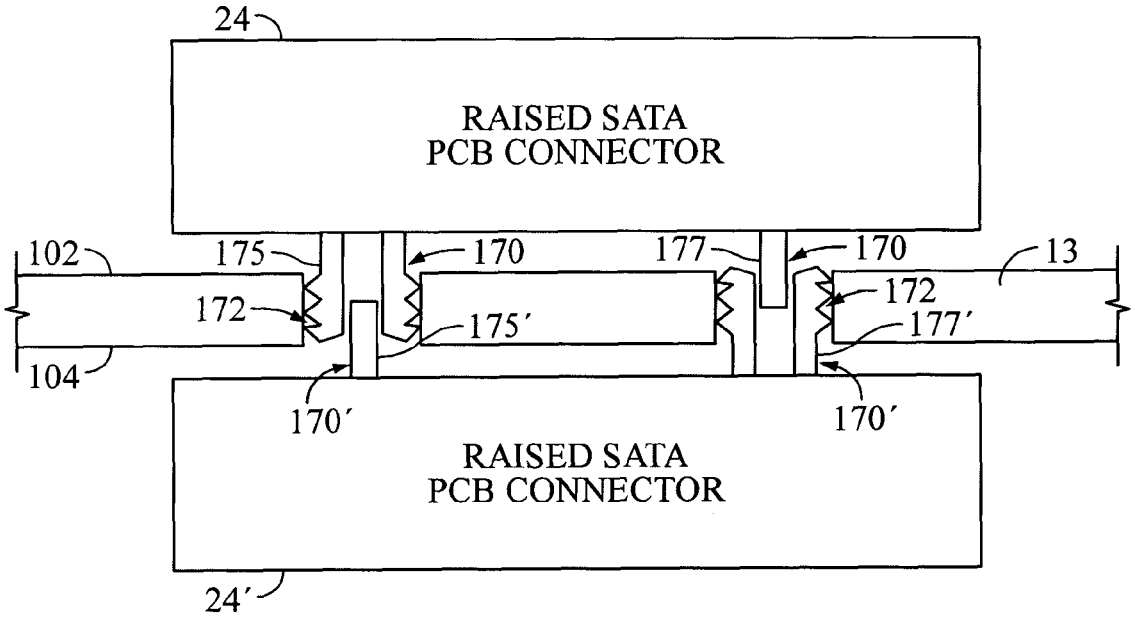
FIG. 6 is a diagram illustrating a fastener arrangement to mount the first and second raised SATA PCB connectors to a PCB, according to one embodiment of the present invention.

Turning now to FIG. 6, FIG. 6 is a diagram illustrating a fastener arrangement to mount the first and second raised SATA PCB connectors 24, 24' to a PCB 13, according to one embodiment of the present invention. Particularly, each of the first and second raised SATA PCB connectors 24, 24' include a pair of fasteners 170, 170' to mount the raised mounting portion 115 of each of the first and second raised SATA PCB connectors 24, 24' to through holes 172 of the PCB 13, respectively, such that the first raised SATA PCB connector 24 is mounted to the first side 102 of the PCB 13 and the second raised SATA PCB connector 24' is mounted to the second side 104 of the PCB 13. For example, the fasteners 170, 170' may be mounting barbs.

In one embodiment, first and second split-design mounting barbs 175 and 177 are used to mount the first raised SATA PCB connector 24 to the through holes 172 of the PCB 13. Further, first and second complementary split-design mounting barbs 175' and 177' are used to mount the second raised SATA PCB connector 24' to the through holes 172 of the PCB 13. The first and second complementary split-design mounting barbs 175' and 177' of the second raised SATA PCB connector 24' have a rotated orientation of approximately 90 degrees with respect to the split-design mounting barbs 175 and 177 of the first raised SATA PCB connector 24. In this way, the first and second mounting barbs 175 and 177 and the first and second complementary mounting barbs 175' and 177' fit within one another, as shown in FIG. 6, while securing the respective first and second raised SATA PCB connector 24, 24' to the through holes 172 of the PCB 13.

Further, as shown in FIG. 6, in one embodiment, the mounting barbs of each of the first and second raised SATA PCB connectors 24, 24' may be rotated with respect to one another, e.g. by 90 degrees, such that raised SATA PCB connectors are interchangeable and may be mounted to either the top or bottom side of the PCB in opposed relation to one another. However, it should be appreciated that the mounting barbs for a particular raised SATA PCB connector may also be oriented the same way, as long as the opposed raised SATA PCB connector has mounting barbs both having a 90 degree complementary orientation thereto.

The mounting barbs 175, 177 175', 177' may be used to permanently affix the first and second raised SATA PCB connectors 24 and 24' to the PCB 13 or may be used merely to hold the raised SATA PCB connectors in place on their way during the manufacturing process to wave soldering for permanent attachment. Also, it desirable for the mounting barbs not to go all the way through the through holes 172 of the PCB 13 to aid in pasting and soldering during the manufacturing process.

Other modifications and embodiments will occur to those of skill in this art and all such modifications and other embodiments are deemed to fall within the scope of the present invention.

I claim:

1. A raised Serial Advanced Technology Attachment (SATA) Printed Circuit Board (PCB) connector mounted to a printed circuit board, the raised SATA PCB connector configured for connection with a SATA cable connector in a direction parallel to the PCB and mounted onto a first side of a PCB in opposing relation with another raised SATA PCB connector similarly mounted onto a second side of the PCB and also configured for connection with a SATA cable connector, the raised SATA PCB connector comprising:

a blade connector for supporting an electrical contact arrangement compatible with a SATA standard; and a raised mounting portion mounted to a first side of a PCB, the raised mounting portion extending directly from the PCB;

wherein the blade connector is integrally formed with the raised mounting portion and projects from the raised mounting portion, the blade connector projecting from the raised mounting portion at a sufficient height from the PCB to allow the blade connector to suitably connect with a SATA cable connector and to allow another SATA cable connector to be suitably connected to another connector mounted in opposing relation to the second side of the PCB.

2. The raised SATA PCB connector of claim 1, wherein the electrical contact arrangement of the blade connector is configured for data signals in accordance with a SATA standard.

3. The raised SATA PCB connector of claim 1, further comprising a SATA cable connector receiving area formed around the blade connector for receipt of the SATA cable connector.

4. A multi-port Printed Circuit Board Assembly (PCBA) comprising:

a Printed Circuit Board (PCB) for mounting within a host computer; and a pair of first and second raised Serial Advanced Technology Attachment (SATA) Printed Circuit Board (PCB) connectors for mounting to the PCB, the first raised SATA PCB connector configured for connection with a first SATA cable connector in a direction parallel to the PCB and mounted onto a first side of the PCB, the second raised SATA PCB connector mounted onto a second side of the PCB in opposing relation to the first raised SATA PCB connector and configured for connection with a second SATA cable connector in a direction parallel to the PCB, each of the first and second raised SATA PCB connectors including:

a blade connector supporting an electrical contact arrangement compatible with a SATA standard; and a raised mounting portion mounted to a side of a PCB, the raised mounting portion extending directly from the PCB;

wherein each blade connector of each of the first and second raised SATA PCB connectors is integrally formed with the raised mounting portion of each of the first and second raised SATA PCB connectors, respectively, and projects from the raised mounting portion; and wherein each blade connector projects from each raised mounting portion of each of the first and second raised SATA PCB connectors, respectively, at a sufficient height from the PCB to allow each blade connector to connect with a respective SATA cable connector such that the first SATA cable connector is connectable to the first raised SATA PCB connector and the second SATA cable connector is connectable to the second raised SATA PCB connector.

5. The multi-port PCBA of claim 4, wherein each electrical contact arrangement of each blade connector is configured for data signals in accordance with a SATA standard.

6. The multi-port PCBA of claim 4, wherein each of the first and second raised SATA PCB connectors each includes a SATA cable connector receiving area formed around the blade connector for receipt of a SATA cable connector.

* * * * *